US009248334B2

(12) United States Patent
Dupuis

(10) Patent No.: US 9,248,334 B2
(45) Date of Patent: Feb. 2, 2016

(54) ADJUSTABLE HANDLE WEIGHT BAR

(71) Applicant: Serge Dupuis, Gatineau (CA)

(72) Inventor: Serge Dupuis, Gatineau (CA)

( * ) Notice: Subject to any disclaimer, the term of this patent is extended or adjusted under 35 U.S.C. 154(b) by 139 days.

(21) Appl. No.: 14/030,308

(22) Filed: Sep. 18, 2013

(65) Prior Publication Data

US 2014/0087925 A1 Mar. 27, 2014

Related U.S. Application Data

(60) Provisional application No. 61/702,381, filed on Sep. 18, 2012.

(51) Int. Cl.

| | |
|---|---|
| ***A63B 21/08*** | (2006.01) |
| ***A63B 21/062*** | (2006.01) |
| ***A63B 21/072*** | (2006.01) |
| ***A63B 21/00*** | (2006.01) |
| ***A63B 23/04*** | (2006.01) |
| ***A63B 23/12*** | (2006.01) |

(52) U.S. Cl.

CPC ..... *A63B 21/062* (2013.01); *A63B 21/00047* (2013.01); *A63B 21/0724* (2013.01); *A63B 21/1469* (2013.01); *A63B 23/0405* (2013.01); *A63B 23/1236* (2013.01); *A63B 2023/0411* (2013.01)

(58) Field of Classification Search

CPC ..... A63B 21/0724; A63B 21/0722; A63B 21/072; A63B 21/0728; A63B 21/078; A63B 21/062; A63B 21/1469; A63B 23/0405; A63B 23/1236; A63B 23/0411; A63B 21/0004; A63B 21/06; A63B 21/0726; A63B 21/075; A63B 21/1446; A63B 21/1465; A63B 21/1484; A63B 2021/0783; A63B 2021/0786; A63B 23/02; A63B 23/0233; A63B 23/0238; A63B 2208/0204; A63B 2208/0209; A63B 2023/0411

USPC ..... 482/97, 106

See application file for complete search history.

(56) References Cited

U.S. PATENT DOCUMENTS

| | | | | |
|---|---|---|---|---|
| 4,743,018 | A * | 5/1988 | Eckler | 482/106 |
| 4,765,612 | A * | 8/1988 | Henry, Jr. | 482/105 |
| 4,863,158 | A * | 9/1989 | Tassone | 482/140 |
| 4,900,015 | A | 2/1990 | Dissenger | 482/141 |
| 5,071,117 | A * | 12/1991 | Mautner et al. | 482/57 |
| 5,836,858 | A * | 11/1998 | Sharff | 482/106 |
| 6,004,245 | A * | 12/1999 | Boos | 482/93 |
| 6,663,542 | B1 * | 12/2003 | Trabbic | 482/106 |
| 7,108,636 | B1 * | 9/2006 | Garcia | 482/40 |
| 7,637,851 | B1 | 12/2009 | Lormil | 482/95 |
| 2004/0242385 | A1 * | 12/2004 | Emick | 482/106 |
| 2006/0252612 | A1 * | 11/2006 | Melcer | 482/94 |
| 2010/0160124 | A1 * | 6/2010 | Berenshteyn | 482/106 |

* cited by examiner

*Primary Examiner* — Oren Ginsberg
*Assistant Examiner* — Nyca T Nguyen
(74) *Attorney, Agent, or Firm* — Teitelbaum & MacLean; Neil Teitelbaum; Douglas MacLean

(57) ABSTRACT

A multi-use exercise device includes a shaft extending between ground-engaging support structures with a pair of arms rotatable around the shaft into a plurality of various angular positions relative to the ground providing a plurality of different exercises with a plurality of different levels of difficulty. The exercise device can be used as a support structure for pushup and planking exercises, as well as shoulder mounted weight support for squats and lunges.

14 Claims, 8 Drawing Sheets

ADJUSTABLE HANDLE WEIGHT BAR

CROSS-REFERENCE TO RELATED APPLICATIONS

The present invention claims priority from U.S. Patent Application No. 61/702,381 filed Sep. 18, 2012, which is incorporated herein by reference.

TECHNICAL FIELD

The present invention relates to an exercise device and in particular to a multi-use exercise device for facilitating a wide range of exercises at various degrees of difficulty.

BACKGROUND OF THE INVENTION

Conventional exercise devices, which enable the user to perform elevated push-ups and dips, include a frame with two vertical stanchions interconnected by a horizontal cross brace. Typically, hand grips are mounted on the vertical stanchions to position the user's hands during the exercise.

Since user's come in various shapes and sizes, prior art inventions, such as those disclosed in U.S. Pat. No. 4,900,015 issued Feb. 13, 1990 to Dissenger, and U.S. Pat. No. 7,637,851 issued Dec. 29, 2009 to Lormil, provide for the lateral adjustment of the vertical stanchions relative to each other, and the vertical adjustment of the hand grips by simply providing telescopic extendible frame members.

Unfortunately, prior art devices provide limited adjustments to increase the degree of difficulty of individual exercises or increase the number of different exercises that can be performed. Moreover, the aforementioned prior art devices include large and cumbersome frames, meant to remain stationary on the ground for all exercise.

An object of the present invention is to overcome the shortcomings of the prior art by providing a multi-adjustable exercise device providing various degrees of difficulty for each exercise, and a large increase in the number of exercises performed as both a stationary stand and a dynamic weight bearing structure.

SUMMARY OF THE INVENTION

Accordingly, the present invention relates to an exercise device comprising:

a ground engaging base including first and second elongated legs extending parallel to each other;

a shaft extending between the first and second legs spaced from the ground by the ground engaging base;

first and second spaced apart arms, each having a longitudinal axis extending perpendicular to the shaft, each of the first and second arms is rotatable relative to the shaft, and lockable into several angular positions relative to the shaft and independent of each other;

first and second handles mounted on the ends of the first and second arms, respectively, each of the first and second handles rotatable relative to the longitudinal axis of the first and second arms, respectively, lockable at a plurality of angular positions; and first and second weight supporting bars extending outwardly from opposite ends of the shaft, respectively, for supporting additional weights.

BRIEF DESCRIPTION OF THE DRAWINGS

The invention will be described in greater detail with reference to the accompanying drawings which represent preferred embodiments thereof, wherein.

DETAILED DESCRIPTION

Figure 1:
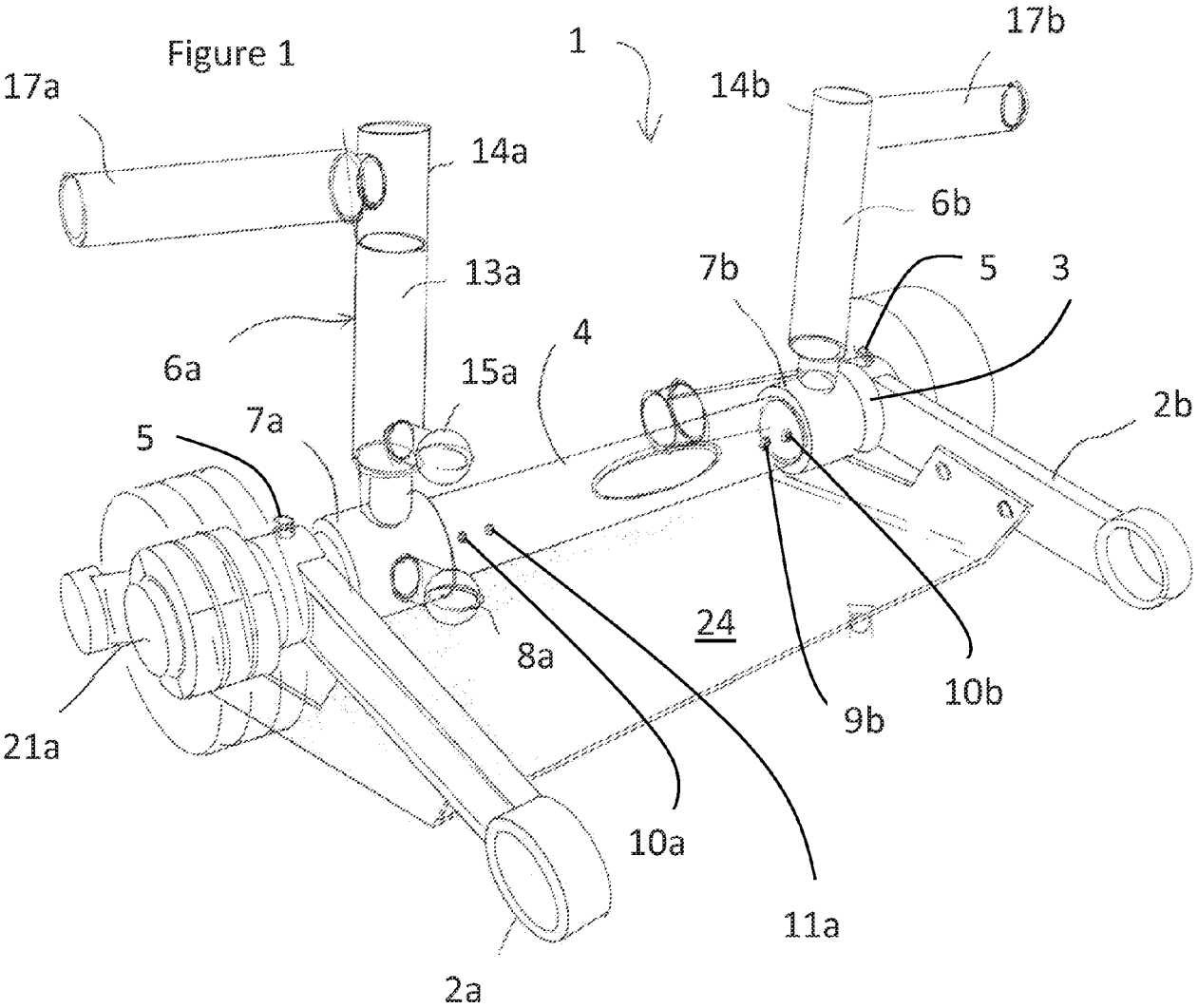
FIG. 1 is an isometric view of a first embodiment of the exercise device of the present invention.
Figure 2:
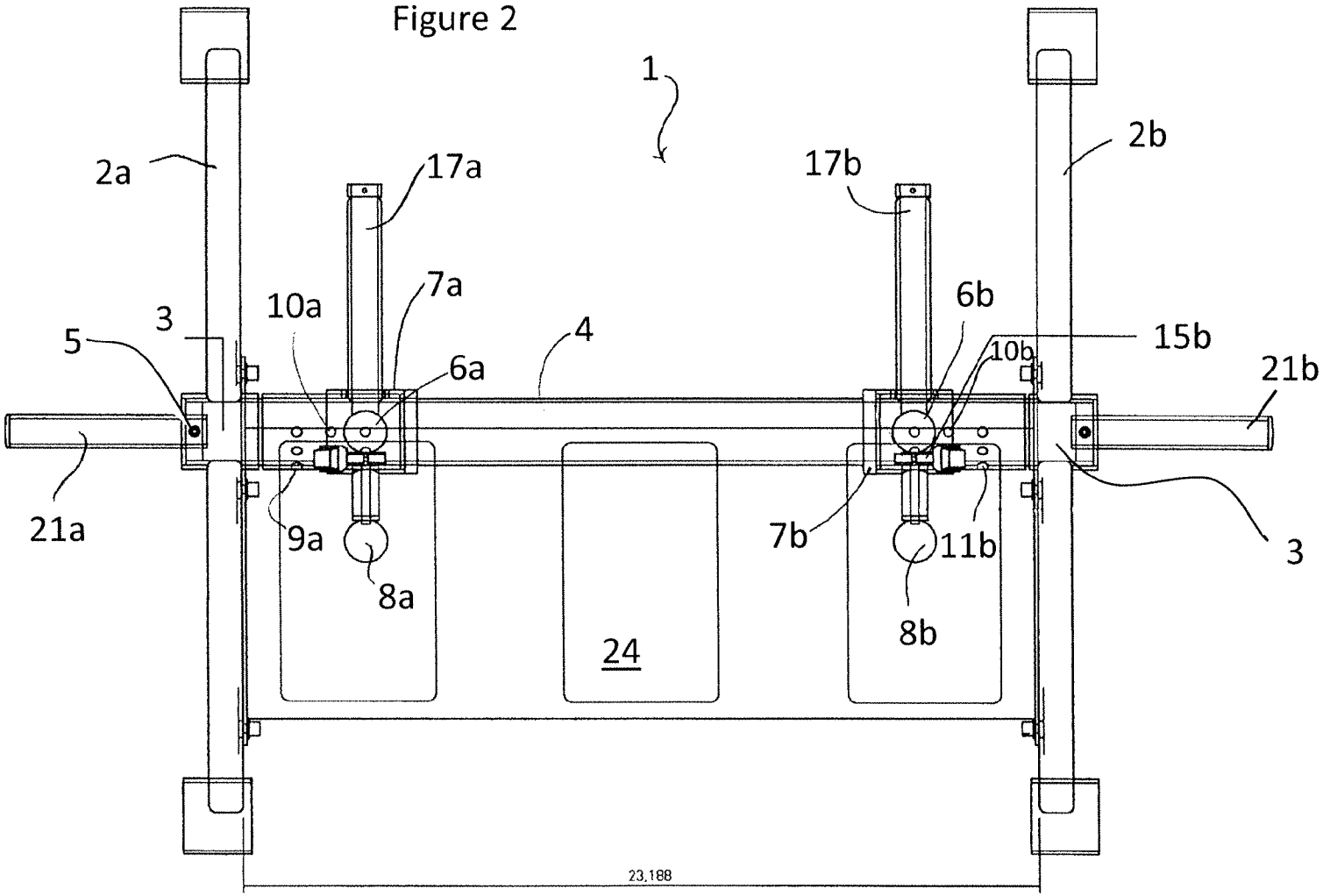
FIG. 2 is a top view of the exercise device of FIG. 1.
Figure 3:
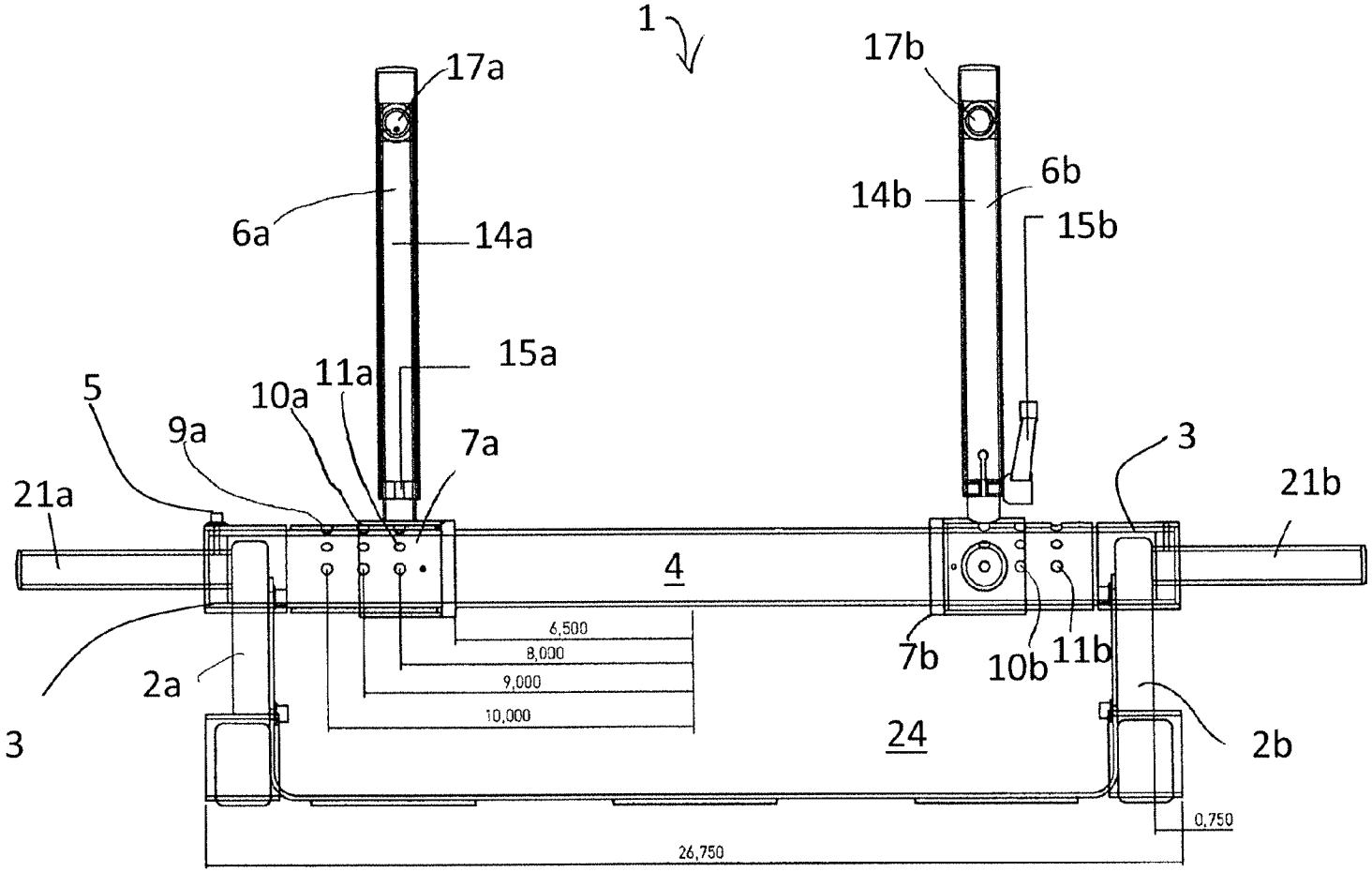
FIG. 3 is a front view of the exercise device of FIGS. 1 and 2.
Figure 4:
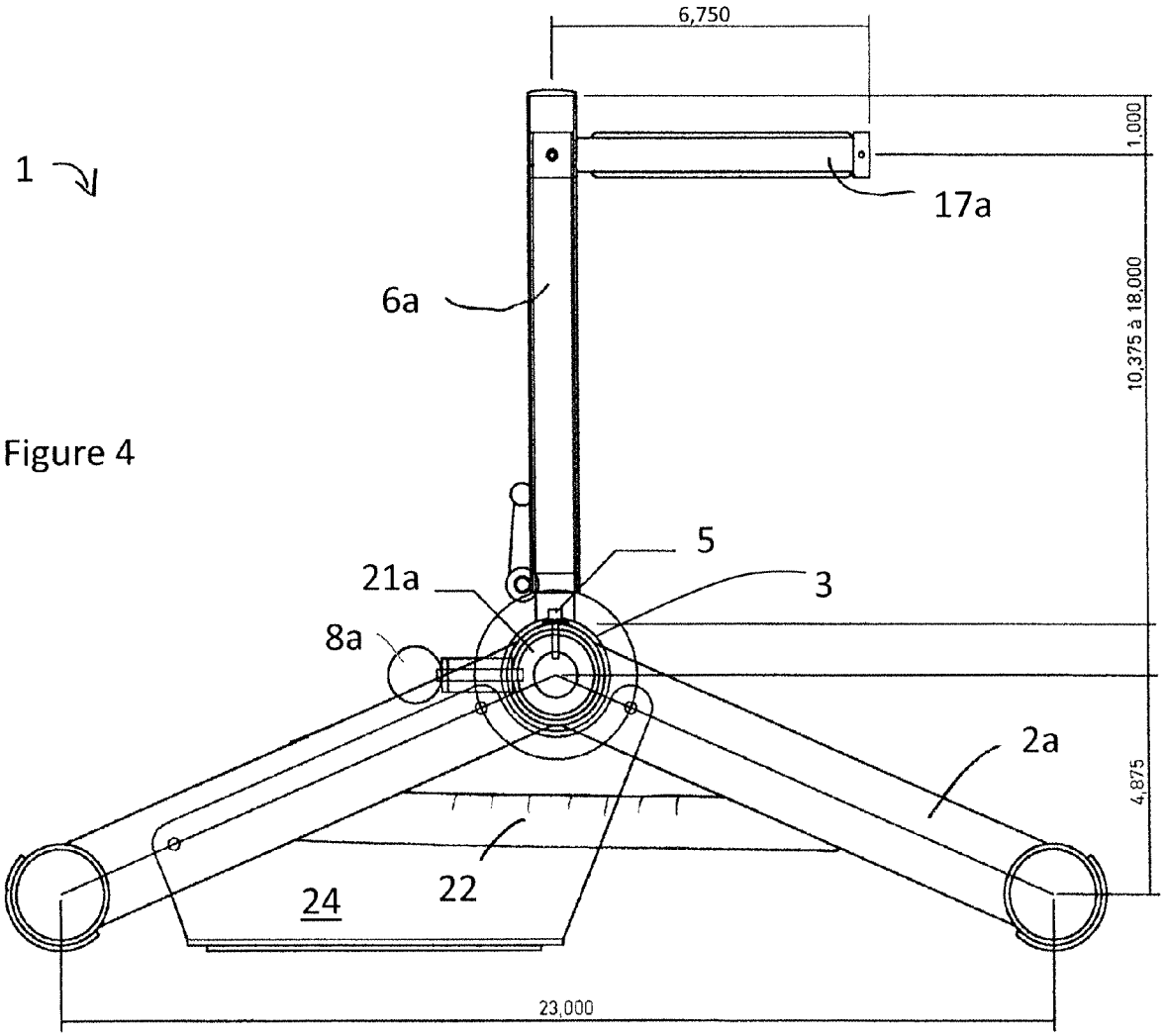
FIG. 4 is a side view of the exercise device of FIGS. 1 to 3.

With reference to FIGS. 1 to 4, the exercise device 1 of the present invention includes a ground-engaging base comprising first and second elongated legs 2*a* and 2*b* extending parallel to each other. The first and second legs 2*a* and 2*b* provide a wide base, e.g. 16 to 24 inches wide, to support a person's body during exercise without flipping. The first and second legs 2*a* and 2*b* can be any suitable shape, e.g. V-shaped, C-shaped or rectangular shaped, and are made of a material, e.g. aluminum, strong enough to support a person's weight while exercising. In the illustrated embodiments, each of the first and second legs 2*a* and 2*b* are V-shaped with a mounting collar 3 at the apex, and rounded, ground-engaging feet at the outer free ends thereof.

A shaft 4 extends between the first and second legs 2*a* and 2*b*, generally perpendicular thereto. The shaft 4 extends through the mounting collars 3, which are secured together with a suitable fastener, e.g. a threaded fastener 5, extending through the collars 3 into contact with the shaft 4. The legs 2*a* and 2*b* provide separation between the shaft 4 and the ground, e.g. by approximately 4 to 6 inches, for reasons explained hereinafter. Typically the shaft 4 is cylindrical and made of a strong material, e.g. steel.

First and second arms 6*a* and 6*b* extend perpendicularly from the shaft 4 and are mounted on the shaft 4 so that the first and second arms 6*a* and 6*b* can rotate about the longitudinal axis of the shaft 4 and can be locked in several different angular positions relative to the base or floor. In the illustrated embodiment, first and second sleeves 7*a* and 7*b*, respectively, forming the base of the first and second arms 6*a* and 6*b*, respectively, surround the shaft 4, and are therefore rotatable relative to the shaft 4. Spring loaded pull-pins 8*a* and 8*b* are used to lock the first and second sleeves 7*a* and 7*b*, respectively, and therefore the arms 6*a* and 6*b*, in one of several different angular positions defined by a series of radially extending holes 9*a* and 9*b* spaced in a line around the circumference of the shaft 4 (see FIGS. 2 and 3). The first and second arms 6*a* and 6*b* can also be moved laterally, i.e. along the longitudinal axis, on the shaft 4 by sliding the sleeves 7*a* and 7*b* longitudinally towards or away from the first leg 2*a*. Additional sets of radially extending holes 10*a* and 10*b*, 11*a* and 11*b* (FIGS. 2 and 3) are provided to enable the first and second arms 6*a* and 6*b* to rotate relative to the shaft 4 at the various lateral positions, which enable the position of the arms 6*a* and 6*b* to be adjusted depending on the exercise, the user's size and arm separation. Typically, each set of holes 9*a*, 10*a* and 11*a* are separated by approximately 2 to 8 cm (1 to 3 inches) providing a total separation between arms 6*a* and 6*b* of about 40 cm to 55 cm, e.g. 41 cm, 46 cm and 51 cm. Moreover, for one set of exercises, e.g. pushups, the arms 6*a* and 6*b* are typically should width apart, while of another set of exercises, e.g. squats with the shaft 4 supported on the user's shoulders, the arms 6*a* and 6*b* should be slightly wider than the user's shoulders.

Each hole in each set of holes 9*a*, 10*a* and 11*a* are angular spaced apart around the circumference of the shaft 4 by approximately 20° to 40°. Accordingly, the angular position of the first and second arms 6*a* and 6*b* can be adjusted to provide a position that is generally perpendicular to a person's body during a push up, e.g. 0° to 15° from vertical or 75° to 90° from horizontal ground. Alternate positions provide a more difficult push up exercise, e.g. 30° to 50° from vertical, and rotating the first and second arms to a substantially horizontal position, e.g. 70° to 85° from vertical, provides an easier carry and storage arrangement, as well as a more convenient lifting position.

Alternative mechanical structures are possible to enable the first and second arms 6*a* and 6*b* to rotate about the shaft 4, and for locking the first and second arms 6*a* and 6*b* into position at the various angular positions.

The length of each of the first and second arms 6*a* and 6*b* is also adjustable, by providing a telescopic structure, including an inner tube 13*a*, 13*b* and an outer tube 14*a*, 14*b*. The relative positions of the inner and outer tubes can be unlocked and locked in various ways, including a lever actuated expanding friction sleeve 15*a* and 15*b* extending through a hole in the outer tube 13*a*/13*b* to the inner tube 14*a*/14*b*. Rotation of the levers 15*a* and 15*b* causes the expanding friction sleeve to shrink enabling the outer tubes 14*a* and 14*b* to be slid relative to the outer tubes 13*a* and 13*b*, respectively, from a retracted position to any number of extended positions. Rotating the levers 15*a* and 15*b* back to the locked position expands the friction sleeve locking the outer tubes 14*a* and 14*b* relative to the inner tubes 13*a* and 13*b*, respectively.

Extending perpendicularly from the outer free ends of the first and second arms 6*a* and 6*b* are first and second handles 17*a* and 17*b*, which are rotatable relative to the longitudinal axis of the first and second arms 6*a* and 6*b*, respectively, about a 360° angle providing various hand positions for exercises, such as pushups (handles 17*a* and 17*b* fixed, pointed inwardly at each other), curls (handles 17*a* and 17*b* fixed, pointed outwardly in opposite directions), and squats (fixed, parallel to each other, pointing towards user). In this embodiment, the angular position of the handles 17*a* and 17*b* is adjusted in the same manner as the length, i.e. releasing the levers 15*a* and 15*b*, which enables the outer tubes 14*a* and 14*b* to be rotated about the longitudinal axis of the inner tubes 13*a* and 13*b*, respectively, thereby rotating the handles 17*a* and 17*b* about the longitudinal axis of the inner tubes 13*a* and 13*b*.

To provide additional exercises, extension bars 21*a* and 21*b* are provided, extending outwardly from the ends of the shaft 4, separate from the arms 6*a* and 6*b*, for supporting conventional weight plates. The extension bars 21*a* and 21*b* can be permanently fixed to the opposite ends of the shaft 4 or they can be removable and conveniently locked into position, when desired. If the first and second arms 6*a* and 6*b* are rotated to the closed or storage position, proximate the first and second legs 2*a* and 2*b*, the shaft 4 can be grasped by one or both hands, and the device 1 can be lifted like a dumbbell. Clips (not shown) can be provided for securing the weights on the bars 21*a* and 21*b*.

Handles 22, extending perpendicular to the shaft 4, can be provided on the first and second legs 2*a* and 2*b*, respectively, to facilitate lifting of the entire device 1 with the extra weight plates on the bars 21*a* and 21*b*, in an alternative weight lifting exercise. A tray 24, extending between the first and second legs 2*a* and 2*b* for contacting the ground, provides a foot rest to stabilize the device during some exercises or during adjustment of the various elements.

Figures 5A, 5B, 5C:
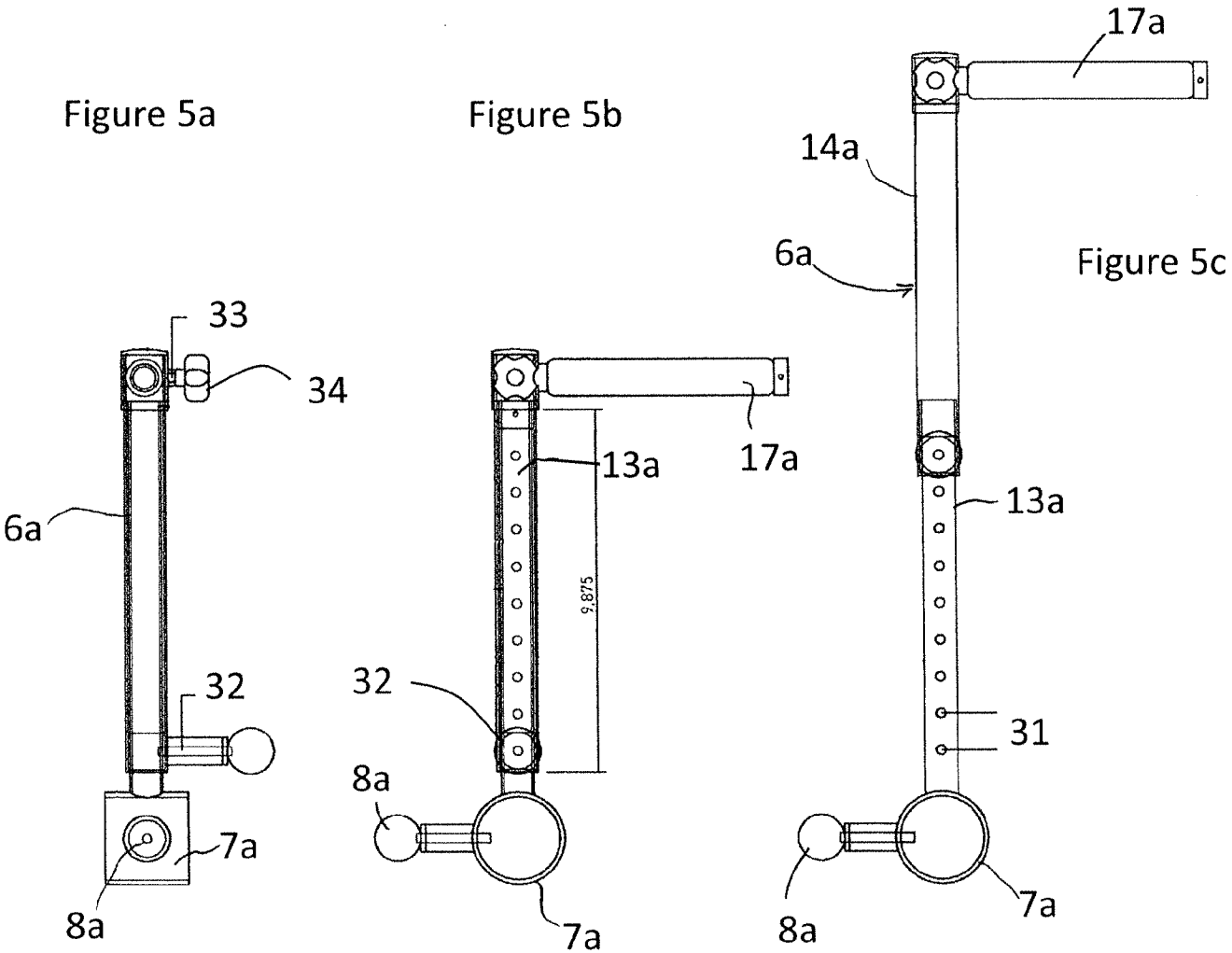
FIG. 5*a* is a front view of an extendable arm of the exercise device of FIGS. 1 to 4.
FIGS. 5*b* and 5*c* are side views of the extendable arm of FIG. 5*a* in the fully retracted and fully extended positions, respectively.

With reference to FIGS. 5*a* to 5*c*, in an alternate embodiment of the present invention is provided for adjusting the length of the arms 6*a* and 6*b*, and the rotational position of the handles 17*a* and 17*b*. The inner tubes 13*a* and 13*b* are provided with a series of spaced apart and aligned holes 31, while the outer tubes 14*a* and 14*b* are provided with a spring loaded pin 32, which extends through the outer tubes 14*a* and 14*b* into engagement with one of the holes 31 for locking the outer tubes 14*a* and 14*b* relative to the inner tubes 13*a* and 13*b*, respectively. A set screw 33, with a lever or knob 34 on the end to facilitate rotation, is provided for loosening and tightening the handles 17*a* and 17*b* in any angular position desired perpendicular to the arms 6*a* and 6*b*, respectively.

Figure 6:
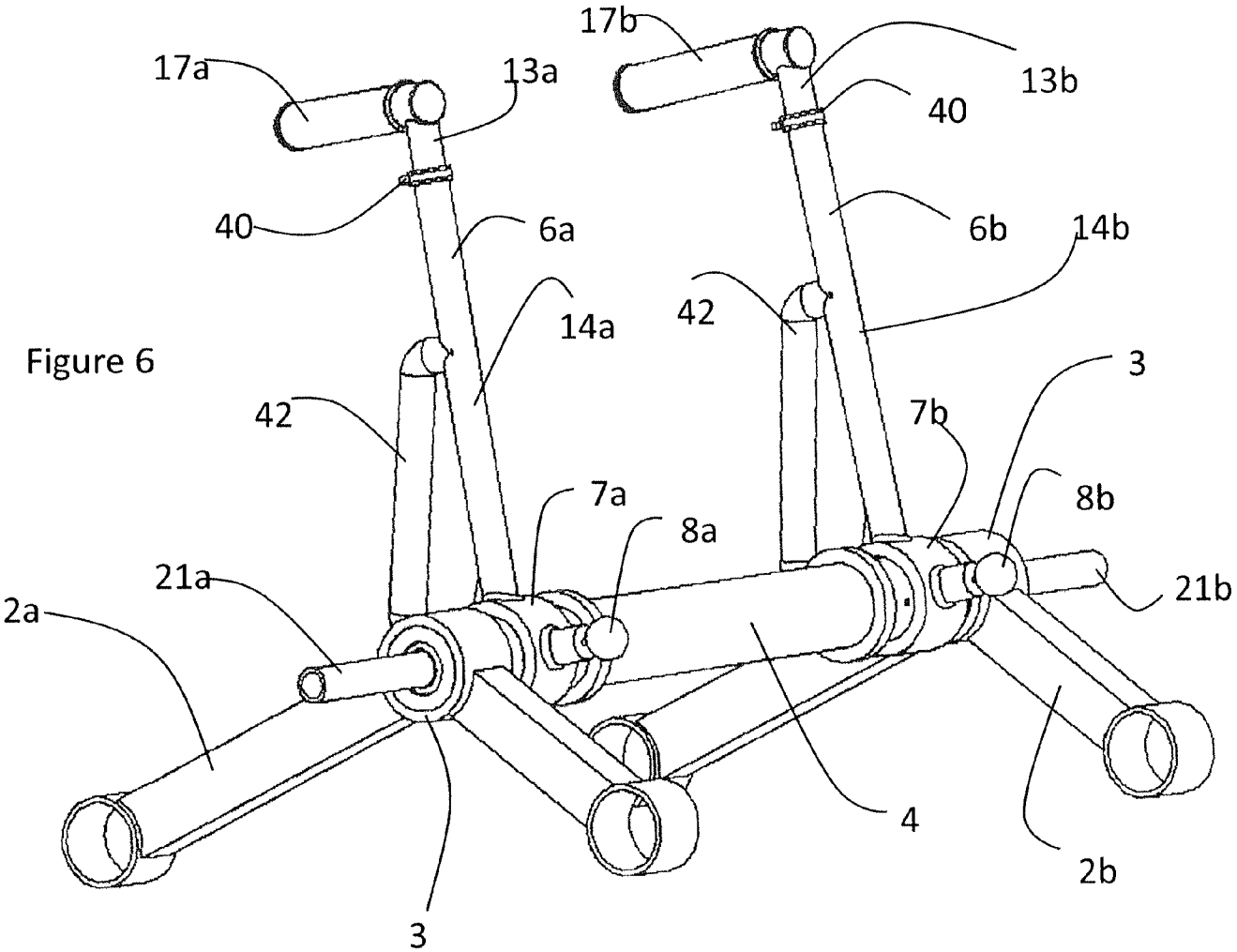
FIG. 6 is an isometric view of a second embodiment of the exercise device of the present invention.
Figure 7:
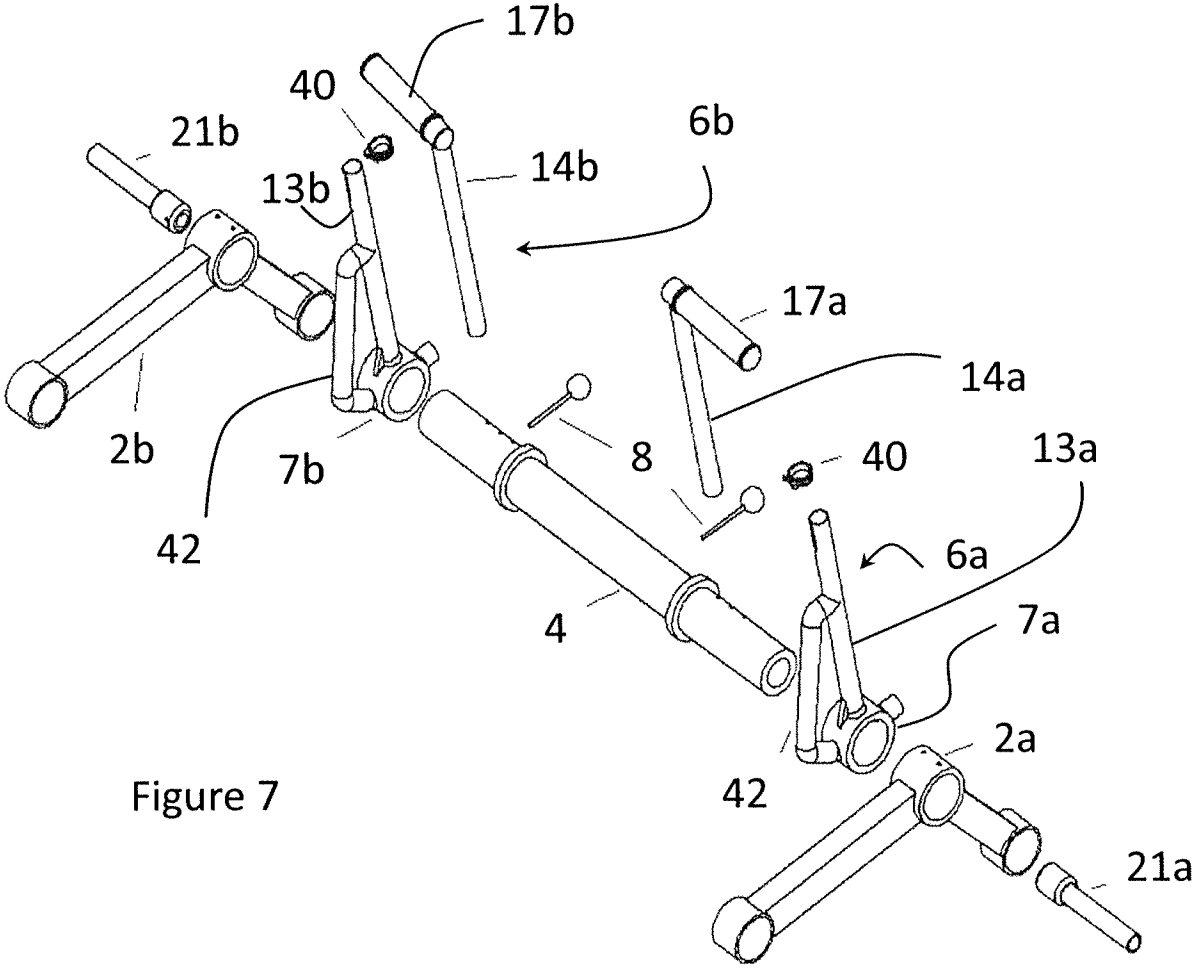
FIG. 7 is an exploded isometric view of the exercise device of FIG. 6.
Figure 8:
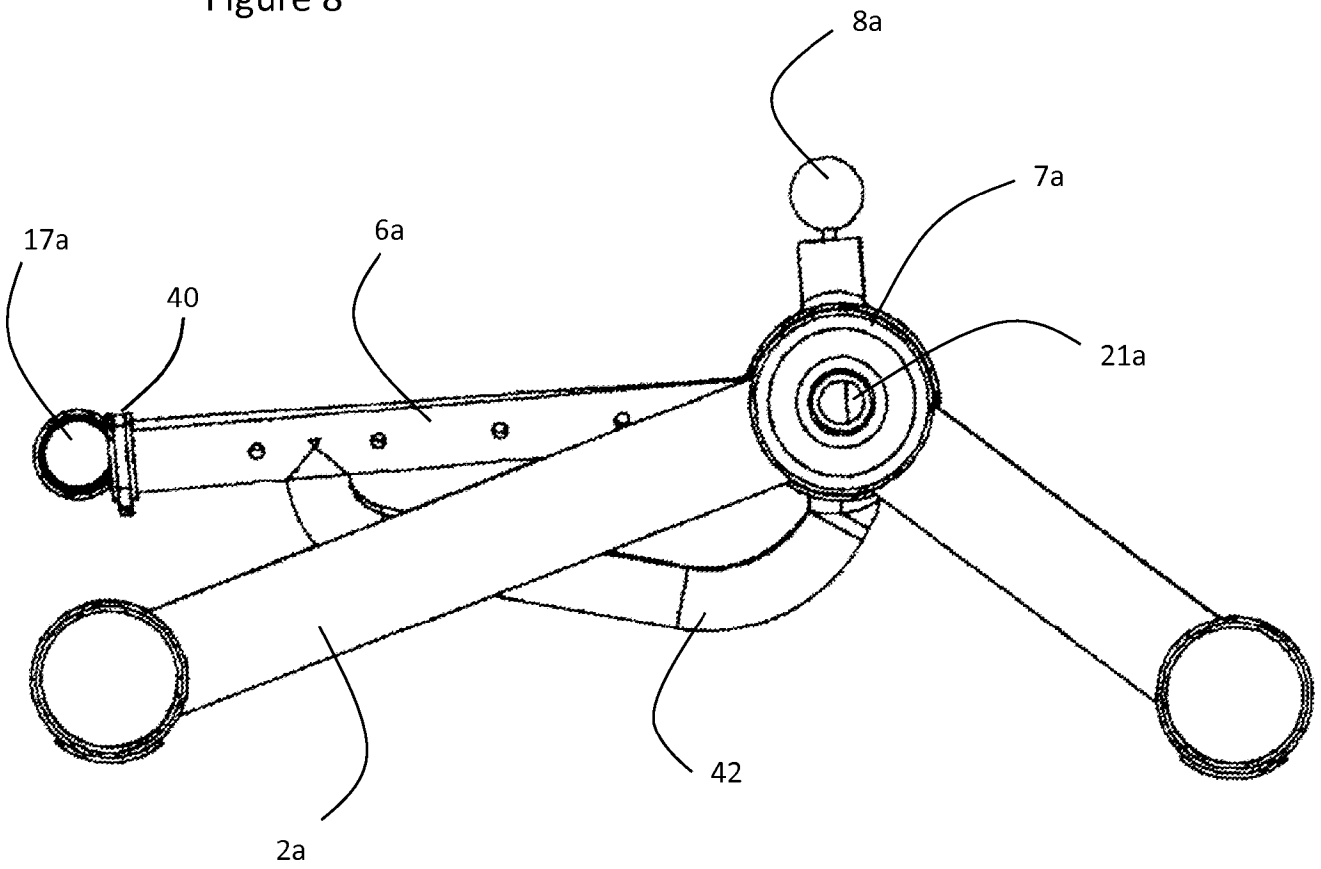
FIG. 8 is a side view of the exercise device of FIGS. 6 and 7.

With reference to FIGS. 6 to 8, an alternative mechanical structures can be provided for locking the inner and outer tubes in position, such as a compression friction clamp 40, positioned at the top of the outer tubes 14*a* and 14*b* for locking both the position of the inner tubes 13*a* and 13*b*, i.e. the length of the arms 6*a* and 6*b*, as well as the angular position of the handles 17*a* and 17*b*.

In the embodiment illustrated in FIGS. 6 to 8, the handles 22 and the tray 24 are omitted to simplify the design. Furthermore, each outer tube 14*a* and 14*b* includes a strengthening brace 42 extending from approximately the midpoint of the outer tube 14*a* and 14*b* to the base of the outer tube 14*a* and 14*b*, i.e. the collar 7*a* and 7*b*, respectively. The braces 42 provide reinforcement for the first and second arms 6*a* and 6*b*, while the first and second arm 6*a* and 6*b* are in an upright position (FIG. 6), and provide handles for lifting the device, while the first and second arms 6*a* and 6*b* are in a closed position (FIG. 8). All the other elements are substantially the same as the previous embodiment.

The structure and adjustability of the present invention enables the user to perform dozens of different exercises, including several with the device stationary on the ground, several with the device being lifted off of the ground, several with the device lifted from one raised position to another, and several with the device supported on the user's body.

The first set of exercises in which the legs 2*a* and 2*b* are stationary on the ground and the arms 6*a* and 6 are extended upwardly in the upright position include pushups, high planks and side planks all with various arm angles and handle angles.

The second set of exercises in which the device is lifted off the ground with the arms 6*a* and 6*b* extended upwardly include, chest presses and curls. The handles 17*a* and 17*b* can be rotated to extend towards each other or away from each other. The bars 21*a* and 21*b* enable additional weight to the added for a more strenuous workout. When the arms 6*a* and 6*b* are rotated substantially parallel with the ground in the closed position, the device can also be used for deadlifts, arm raises, pull overs, and leg raises. With the arms 6*a* and 6*b* rotated downwardly, the shaft 4 or the braces 42 provide hand grips, and the bars 21*a* and 21*b* enable additional weight to be added. With the arms 6*a* and 6*b* in the closed position, the device becomes much less awkward to lift, eliminating the moment caused by the arms 6*a* and 6*b* extending in a direction perpendicular to the legs 2*a* and 2*b*.

The third set of exercises are performed with the arms 6*a* and 6*b* rotated down adjacent the legs 2*a* and 2*b*, respectively in the closed position. They include single arm curls, double arm curls, shoulder presses, triceps curls. Again, additional weight can be added onto the bars 21*a* and 21*b*, and the arms

6*a* and 6*b* and the legs 2*a* and 2*b* extend in the same general direction providing a much less awkward device during lifting.

The fourth set of exercise are performed with the shaft 4 supported on the user's shoulders, and with the arms 6*a* and 6*b* rotated down parallel to the legs 2*a* and 2*b*, respectively, in the closed position extending outwardly from each side of the user's head, wherein the handles 17*a* and 17*b*, rotated to extend in opposite directions, provide convenient hand grips for balancing and supporting the device in place. Providing the handles 17*a* and 17*b* in front of the user and below shoulder height instead of behind the user and above should height greatly enhances the ease at which the device can be balanced on the user's shoulders throughout the range of exercises and movements. These exercises include a wide variety of squats and lunges.

I claim:

1. An exercise device comprising:

a ground engaging base including first and second elongated legs extending parallel to each other;

a shaft extending between the first and second legs spaced from the ground by the ground engaging base;

first and second spaced apart arms, each having a longitudinal axis extending perpendicular to the shaft, each of the first and second spaced apart arms is rotatable relative to the shaft, and lockable into several angular positions relative to the shaft and independent of each other;

first and second handles mounted on the ends of the first and second spaced apart arms, respectively, each of the first and second handles rotatable relative to the longitudinal axis of the first and second spaced apart arms, respectively, lockable at a plurality of angular positions; and first and second weight supporting bars extending outwardly from opposite ends of the shaft, respectively, for supporting additional weights;

wherein the ground engaging base is secured to the shaft enabling lifting of the entire exercise device for a lifting exercise.

2. The device according to claim 1, wherein the first and second spaced apart arms includes a first and second sleeve, respectively, surrounding the shaft.

3. The device according to claim 2, further comprising first and second removable pins extending through the first and second sleeves, respectively; and wherein the shaft includes first and second sets of circumferentially spaced holes, one set of holes proximate to each end of the shaft, the circumferentially space holes being spaced apart around the circumference of the shaft for receiving the first and second pins for locking the first and second spaced apart arms, respectively, at any one of the plurality of angular positions.

4. The device according to claim 3, wherein the circumferentially spaced holes are spaced apart at about 20° to 40°.

5. The device according to claim 4, wherein the angular positions of the first and second spaced apart arms include an upright position 0° to 15° from vertical, a middle position 30° to 50° from vertical, and a closed position 70° to 85° from vertical.

6. The device according to claim 4, wherein the shaft includes third and fourth sets of circumferentially spaced holes laterally spaced from the first and second sets of circumferentially spaced holes, respectively, enabling the first and second spaced apart arms to be locked in a plurality of laterally spaced apart positions along the longitudinal axis of the shaft and at a plurality of angular positions around the circumference of the shaft.

7. The device according to claim 6, wherein the first and third sets of circumferentially spaced holes are spaced apart by about 1" to 3".

8. The device according to claim 5, further comprising a brace extending between each sleeve and a midway point of each of the first and second spaced apart arms for reinforcing the first and second spaced apart arms at the upright position and for providing hand grips for lifting the device at the closed position.

9. The device according to claim 1, wherein the first and second spaced apart arms are vertically extendable.

10. The device according to claim 9, wherein each of the first and second spaced apart arms comprises:

a first tube extending from a sleeve; and a second tube with the corresponding first and second handle at the outer free end thereof, telescoping with the first tube.

11. The device according to claim 10, further comprising a friction clamp extending between the first and second tubes;

wherein the friction clamp is adjustable between an open position in which the second tube is rotatable and translatable relative to the first tube, and a locked position in which the second tube is fixed relative to the first tube.

12. The device according to claim 1, wherein the first and second spaced apart arms are laterally adjustable relative to each other along the longitudinal axis of the shaft.

13. The device according to claim 1, wherein the angular positions of the first and second spaced apart arms include an upright position 0° to 15° from vertical, a middle position 30° to 50° from vertical, and a closed position 70° to 85° from vertical.

14. An exercise device comprising:

a ground engaging base including first and second elongated legs extending parallel to each other;

a shaft extending between the first and second legs spaced from the ground by the ground engaging base;

first and second spaced apart arms, each having a longitudinal axis extending perpendicular to the shaft, each of the first and second spaced apart arms is rotatable relative to the shaft, and lockable into several angular positions relative to the shaft and independent of each other;

first and second handles mounted on the ends of the first and second spaced apart arms, respectively, each of the first and second handles rotatable relative to the longitudinal axis of the first and second spaced apart arms, respectively, lockable at a plurality of angular positions;

first and second weight supporting bars extending outwardly from opposite ends of the shaft, respectively, for supporting additional weights; and braces on each of the first and second spaced apart arms for reinforcing the first and second arms at an upright position and for providing hand grips for lifting the device at a closed position.

* * * * *